US005797200A

United States Patent [19]

Hess et al.

[11] Patent Number: 5,797,200

[45] **Date of Patent: *Aug. 25, 1998**

[54] SHOE WITH STRETCHABLE TOP

[75] Inventors: Robert Hess, New Holstein; Robert Marquardt, Sheboygan, both of Wis.

[73] Assignee: Redwood Sportswear Ltd., New Holstein, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 752,446

[22] Filed: Nov. 15, 1996

[51] Int. Cl.[6] ..... A43B 3/26; A43B 23/26

[52] U.S. Cl. ..... 36/97; 36/51; 36/54

[58] Field of Search ..... 36/97, 51, 54

[56] References Cited

U.S. PATENT DOCUMENTS

| | | | |
|---|---|---|---|
| 732,045 | 6/1903 | Cahill | 36/51 |
| 888,994 | 5/1908 | Gilman | 36/51 |
| 1,000,643 | 8/1911 | Thornbury . | |
| 1,139,598 | 5/1915 | Tadakuma . | |
| 1,480,234 | 1/1924 | Wedd . | |
| 1,543,187 | 6/1925 | Peterson et al. . | |
| 1,862,047 | 6/1932 | Boulet et al. | 36/51 X |
| 1,940,542 | 12/1933 | Goth | 36/51 |
| 2,139,858 | 12/1938 | Schwartz et al. | 36/54 |
| 2,140,302 | 12/1938 | Roberts | 36/51 |
| 2,158,153 | 5/1939 | Roberts | 36/51 X |
| 2,205,356 | 6/1940 | Gruensfelder et al. | 36/51 |
| 2,205,577 | 6/1940 | Roberts | 36/51 X |
| 2,332,252 | 10/1943 | Payne | 36/2.5 |
| 2,389,032 | 11/1945 | Donnelly | 36/8.5 |
| 3,769,723 | 11/1973 | Masterson | 36/51 X |
| 3,931,685 | 1/1976 | Laukaitis | 36/51 X |
| 3,952,430 | 4/1976 | Pankin et al. | 36/51 |
| 4,079,527 | 3/1978 | Antonious | 36/51 |
| 4,354,319 | 10/1982 | Block et al. | 36/51 X |
| 4,463,761 | 8/1984 | Pols et al. | 128/581 |
| 4,769,927 | 9/1988 | Liggett et al. | 36/88 |
| 4,811,497 | 3/1989 | Merino Ciudad | 36/51 |
| 5,060,402 | 10/1991 | Rosen | 36/97 |
| 5,383,290 | 1/1995 | Grim | 36/93 |
| 5,384,970 | 1/1995 | Melton | 36/88 |
| 5,408,761 | 4/1995 | Gazzano | 36/88 |

FOREIGN PATENT DOCUMENTS

| | | | |
|---|---|---|---|
| 1200460 | 12/1959 | France | 36/51 |
| 20164 | 12/1904 | Germany | 36/51 |

*Primary Examiner*—Ted Kavanaugh

*Attorney, Agent, or Firm*—Merchant, Gould, Smith, Edell, Welter & Schmidt, P.A.

[57] ABSTRACT

An orthopedic shoe including an elastic top portion conformable to an irregularly shaped foot is disclosed. The orthopedic shoe conforms to the irregularly shaped foot to provide a comfortable fit, retains an attractive appearance, and fits a number of different shaped feet without further customization of the shoe.

8 Claims, 2 Drawing Sheets

SHOE WITH STRETCHABLE TOP

FIELD OF THE INVENTION

The present invention relates to a shoe having a stretchable top. More particularly, the invention relates to a conformable shoe for wearing on an irregularly shaped foot.

BACKGROUND OF THE INVENTION

Many individuals have feet with irregular shapes. People are often born with feet having a shape substantially different from that of the average foot, or their feet differentially develop or alter in shape during growth or during older age. In addition, some people have unique foot forms as a result of accidents which have altered the shape of their foot.

Some people, particularly diabetics and other individuals with poor foot circulation, often have swollen limbs and feet. For these people, their feet may vary in size over time as their health situation changes. A conventional shoe which fits their feet one day may not fit another day if their feet have enlarged or shrunk in the interim. These people have a need for a shoe which easily conforms to an irregularly sized or shaped foot, and particularly a foot which changes in size or shape over time.

Another common irregularity in foot shapes is a raised area on the anterior top of a foot. This irregularity can be particularly troublesome if the foot will not fit within most standard mass-produced shoes. Most mass-produced shoes are constructed in a limited number of sizes and shapes directed toward fitting persons having feet with relatively standard shapes. Such shoes are often constructed of relatively stiff materials such as patent leather which do not permit ready conformation to feet having irregular shapes. Other shoes, while constructed of flexible materials such as nylon or canvas, are not rigid, but the materials are relatively inelastic and therefore are also relatively limited in their ability to conform to a foot having an irregular shape. In some cases, a foot will not even be able to enter the shoe. In other cases, the foot may enter the shoe but not fit comfortably.

The need for a shoe which will accommodate an irregularly shaped foot includes the need for that shoe to have an appearance similar to standard shoes. Thus, it is desirable for the shoe to accommodate the irregularity while preserving a relatively standard appearance, such as in dress shoes for professional or formal purposes, or in casual shoes for informal purposes.

Efforts have been made to create shoes for irregularly shaped feet. For example, U.S. Pat. No. 4,463,761 to Pols et al. discloses an orthopedic shoe for use by a person who has a moderate deformity of the foot. However, the Pols et al. patent requires the application of heat to mold the shoe to accommodate the deformity. This task must often be performed by a technician. In addition, once molded, the orthopedic shoe no longer changes to fit a foot which has periodic alterations in shape, such as that of a diabetic. Likewise, U.S. Pat. No. 2,389,032 to Donnelly requires the removal of a portion of the shoe upper and the insertion of a rigid protective shield over the foot irregularity. Other patents, such as U.S. Pat. No. 5,384,970 provide an adjustable fit shoe, but fail to retain a conventional appearance. Thus, these shoes all have significant drawbacks and fail to fill the need for a comfortable shoe which will retain an attractive standard appearance while still easily fitting feet with irregular shapes.

Consequently, a need exists for a conformable shoe which overcomes the aforementioned shortcomings associated with existing shoes.

SUMMARY OF THE INVENTION

The present invention is directed to a conformable shoe for wearing on a foot having an irregularly shaped area. The shoe includes a sole extending from a toe end to a heel end. An upper having a lower edge secured to the sole is configured for covering a fore section and toes of the irregularly shaped foot. A vamp, comprising a portion of the upper, covers the foresection and toes of the foot and has a top portion constructed solely of an elastic material positioned to cover and conform to the shape of the irregularly shaped area of the foot.

In one embodiment, the top portion of the vamp further comprises a tongue forming an extension of the elastic material. The tongue may further comprise a stiffening material adhered to only a section of the tongue.

The elastic material of the vamp may be secured to an inelastic portion of the vamp by stitches. The top portion of the vamp may be constructed from an elastic material as described herein.

In an implementation of the invention, the sole includes an outer perimeter to which an elastic material is secured and positioned to extend over the irregularly shaped area of the foot. The elastic material may be secured to the outer perimeter of the toe end and positioned to cover a section of the elastic material proximate the sole. In one embodiment, the inelastic upper portion may comprise a crescent portion of the upper and be secured to the toe end of the sole.

The above summary of the invention is not intended to describe each illustrated embodiment or every implementation of the present invention. This is the purpose of the figures and the Detailed Description which follow.

BRIEF DESCRIPTION OF THE DRAWINGS

Other aspects and advantages of the invention will become apparent upon reading the following Detailed Description and upon reference to the drawings in which.

Figure 1:
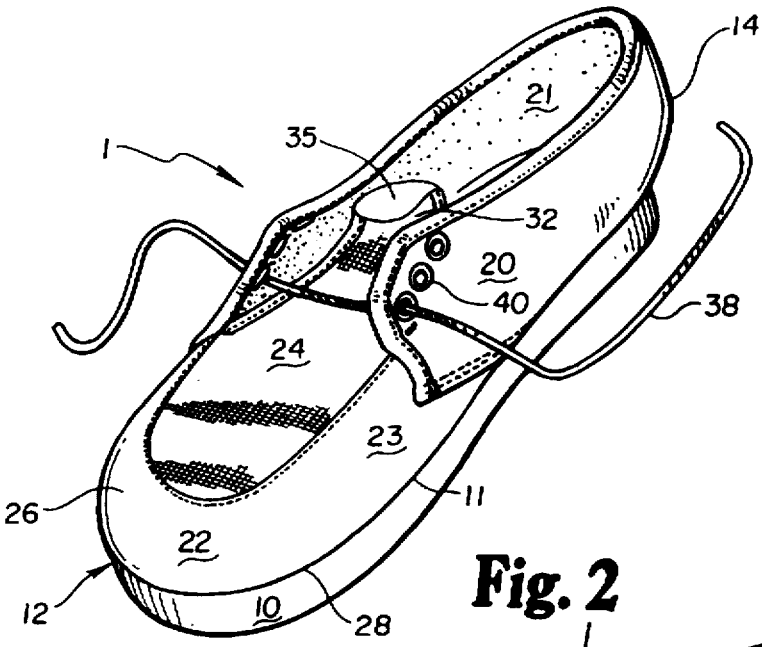
FIG. 1 is a perspective view of an orthopedic shoe embodying the present invention.

While the invention is susceptible to various modifications and alternative forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DETAILED DESCRIPTION

The conformable shoe 1 of the present invention is designed to create an attractive and functional shoe which can be worn by a person having an irregularly shaped foot.

A preferred embodiment of the present invention is shown in FIG. 1. Conformable shoe 1 has a sole 10 extending from a toe end 12 to a heel end 14. The sole 10 is cut to approximate the size of the user's foot and designed to serve a number of purposes, including providing traction on a variety of surfaces, providing a long-wearing bottom that will not quickly abrade under the forces of use, providing resiliency to cushion the impact associated with use, and providing a structure onto which other portions of the shoe may be attached. The sole 10 further includes an edge 11 running along the perimeter of the sole 10. The perimeter of the sole 10 closely corresponds to the outline of the foot, and is slightly larger than the foot.

An upper 20 having a lower edge 28 is secured to the sole 10 by stitches. The upper 20 is configured for covering a foot and retains the foot within the shoe 1. The upper 20 wraps around the sides, front, and back of the wearer's foot and curves inwardly to cover the edges and extremities of the foot, thereby both protecting the foot and retaining the foot within the shoe.

The upper 20 includes a vamp section 22 covering the sides of the foresection and the toes of the foot. The vamp section 22 wraps around the foresection and toes, and is stitched to the toe end and edges 11 of the sole 10. The side wall 23 forming the vamp section 22 extends upward and over the top of the toes and sides of the foot and terminates at a generally u-shaped edge **23*a* covering the top of the foot. The side wall 23 of the vamp section 22 is constructed of a substantially inelastic material—in this case, leather—while the top portion 24 of the vamp is constructed of an elastic material. The elastic top portion 24 is positioned within inner edge 23*a* of the inelastic portion 22** to cover and conform to the shape of an irregular area of the foot.

Figure 2:
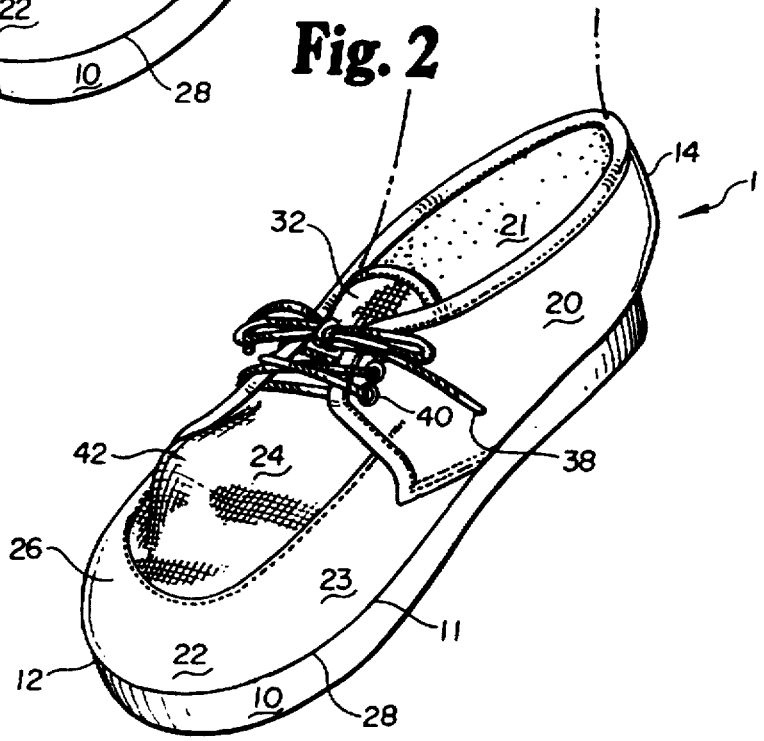
FIG. 2 is a perspective view of an orthopedic shoe embodying the present invention being worn on a foot, showing the foot in phantom dashed lines.
Figure 3:
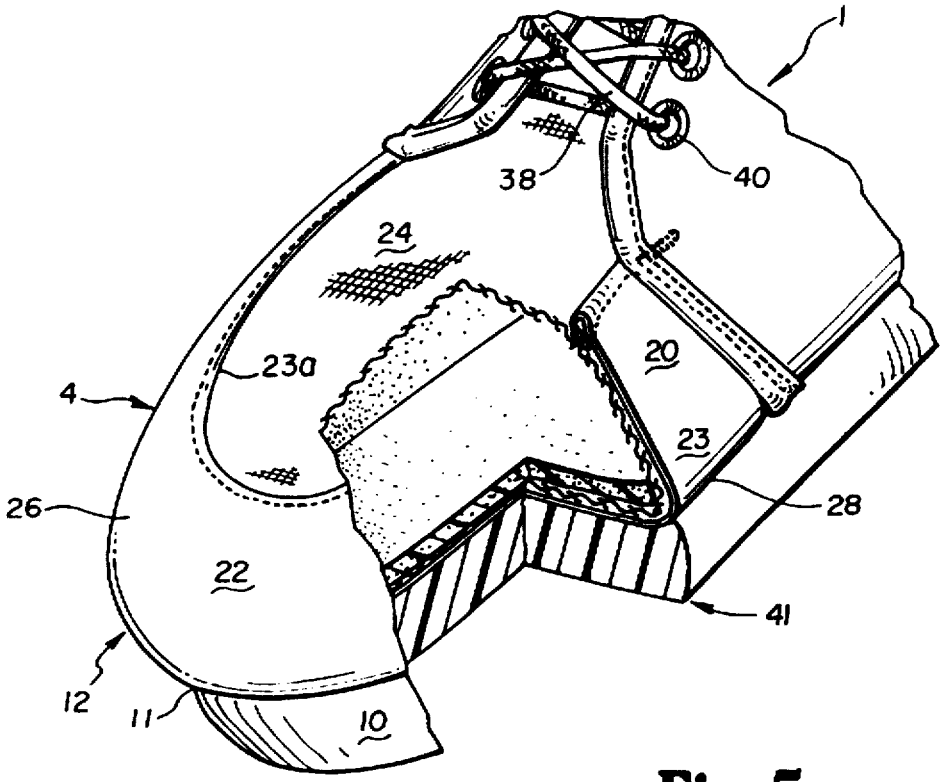
FIG. 3 is an enlarged fragmentary perspective view of an orthopedic shoe embodying the present invention, showing a portion of the front of the shoe broken away and shown in section.
Figure 4:
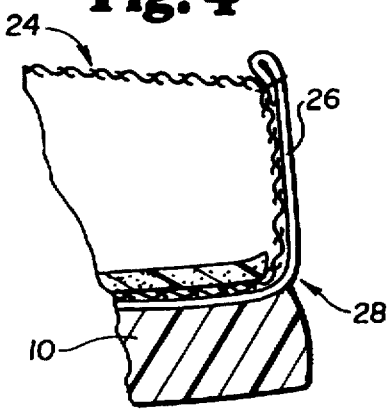
FIG. 4 is a vertical fragmentary section taken along line 4–4' of FIG. 3, portions thereof being broken away.

As is shown in FIG. 2, the elastic portion 24 stretches to conform to the irregularly shaped portion of the foot when the foot is inserted into the shoe 1. The only appearance from the outside of the shoe of this irregularity is a protrusion 42 in the elastic portion 24 corresponding to the irregular area.

The conformable shoe 1 includes laces 38 and eyes 40 for lacing the shoe 1 to a foot. The laces 38 are looped through eyes 40 positioned along the sides of the upper 20, and tied with a knot. The conformable shoe 1 further includes a tongue 32 attached to the vamp 22 and extending toward the heel end 14. The tongue 32 is constructed of the elastic material made to create the elastic portion 24 and is an extension thereof. In addition, a stiffening material is preferably added to the backside 35 of the tongue 32 in order to give the tongue 32 a stiffness to permit it to retain its general form when the foot is removed from the shoe 1. The stiffness also assists in inserting the foot into the shoe by enabling the tongue to be held out of the way of the foot.

Figure 5:
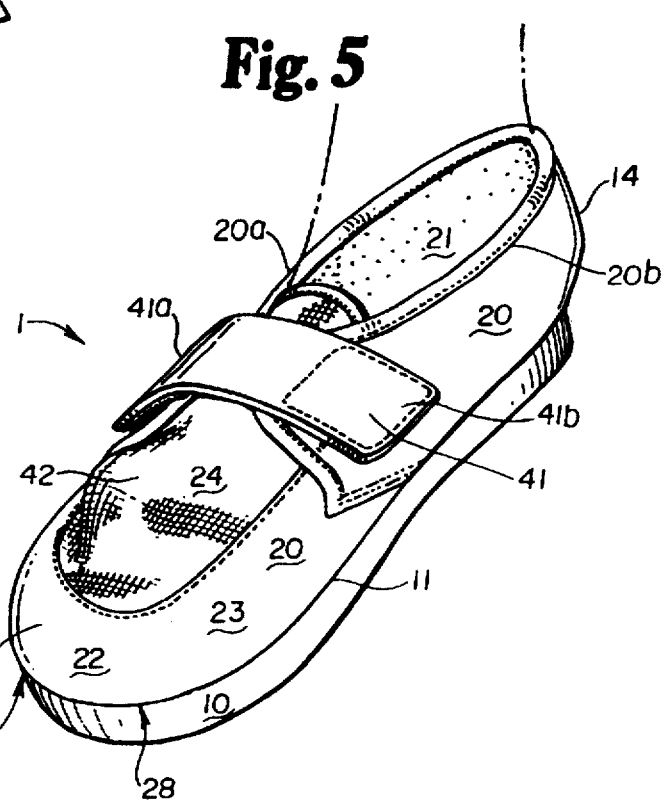
FIG. 5 is a perspective view of an orthopedic shoe embodying the present invention, showing the shoe secured with a strap.

As shown in FIG. 5, an alternative embodiment of the conformable shoe 1 includes a closure 41 utilizing "hook-and-loop" fasteners, commonly sold under the brand name "Velcro". The closure 41 is permanently secured at a first end **41*a* to a side 20*a* of the upper 20. The second end 41*b* of the closure 41 removably secures to a second side 20*b* of the upper 20. The second end 41*b* of the closure 41 and the second side 20*b* of the upper 20 include "hook-and-loop" material which permits them to be securely held to one another when a foot is in the shoe. By lifting up on end 41*b*, the band between the closure 41 and upper 20 is broken, and the foot may be removed from the shoe 1. The closure 41** is configured such that the shoe may be made wider or narrower to fit different width feet or to change the size of the shoe as the foot dimensions change over time.

The elastic material forming the top portion 24 of the vamp is a material having sufficient stretchable qualities to permit it to conform to an irregularly shaped foot. The material should have high abrasion resistance, good resilience such that it can be returned to shape after stretching, and good ability to absorb and transpire moisture. In the preferred embodiment, the elastic material is approximately 85% polyester and 15% Lycra®. The elastic material has enough stretch to conform to the irregularity without creating uncomfortable or painful pressure on the top of the foot. In addition, the elastic material is not so stretchable that the foot slips out of the shoe or slides excessively within the shoe.

The elastic top portion 24 is stitched to edge **23*a* of inelastic side wall 23. These stitches serve to retain the elastic portion in place and also serve to reinforce the upper 20. The elastic portion 24 continues further down along an inside wall of side wall 23 to the sole 10, where it extends below an insole and is adhesively secured in place. The U-shaped elastic top portion 24** is thus part of a larger piece of elastic material that covers the entire front portions of the foot and is secured to the sole.

The shoe 1 includes an opening 21 for insertion of a foot so that it is positioned on top of the sole 10 and substantially enclosed by the upper 20. The vamp section 22 is generally crescent shaped. However, alternative embodiments with other shapes are envisioned and considered within the scope of the patent.

It will be apparent to those skilled in the art that various modifications and variations can be made to the embodiments illustrated herein without departing from the scope or spirit of the invention, as set forth by the following claims.

We claim:

1. A conformable shoe for wearing on a foot having an irregularly shaped frontal area, said conformable shoe comprising:

(a) a sole extending from a toe end to a heel end;

(b) a substantially inelastic upper extending from the sole and along the side of the foot, the inelastic upper extending along an edge of the foot from the toe end to the heel end to form a generally U-shaped inelastic perimeter around the top, front of the foot configured to assist in supporting the foot and in retaining the foot within the shoe; the generally u-shaped elastic upper curving up and over a u-shaped portion of the top front of the foot;

(c) a single-piece elastic vamp portion configured to cover the portion of a foot within the U-shaped inelastic perimeter, such that:

(1) said elastic vamp portion has an inner surface and an outer surface, the inner surface configured such that it is exposed along the front, interior portion of the shoe above the sole;

(2) said outer surface of the elastic vamp portion including a generally ushaped exposed exterior portion on the exterior of the shoe constructed solely of the elastic material positioned to cover and conform to the shape of an irregularly shaped area of the foot by expanding in at least two orientations, said exposed exterior top portion being exposed over substantially all of the top, front of the foot but not along the sides thereof;

(3) said single-piece elastic vamp portion extending around the bottom of the foot and is held in place by an adhesive;

(4) a generally u-shaped sewn seam running along a junction between the exposed outer surface of the exposed exterior elastic portion and the generally inelastic perimeter along the top, front of the foot; and (d) a tongue comprising an extension of the elastic material and constructed of the elastic material, the tongue further comprising a stiffening material adhered to a section of the tongue to assist in retaining the shape of the tongue.

2. The conformable shoe according to claim 1, wherein the lower edge of the substantially inelastic upper is secured to the sole along substantially the entire perimeter of the foot.

3. The conformable shoe of claim 1, wherein the elastic vamp portion is secured to the U-shaped elastic perimeter by stitches.

4. The conformable shoe of claim 1, wherein the elastic vamp portion is constructed from an elastic material selected from the group consisting of polyester and latex rubber.

5. The conformable shoe of claim 1, wherein the elastic vamp portion is constructed from a material combining polyester and Lycra®.

6. The conformable shoe of claim 1, wherein the elastic vamp portion is constructed from approximately 85% polyester and 15% Lycra®.

7. The conformable shoe of claim 1, wherein the shoe is secured to the foot with a hook-and-loop closure extending from a first side of the inelastic upper to a second side of the inelastic upper.

8. The conformable shoe of claim 1, wherein the elastic vamp portion continues beneath the inelastic upper and is secured to the sole of the shoe.

* * * * *